US005887455A

United States Patent [19]

Kim et al.

[11] Patent Number: 5,887,455

[45] Date of Patent: Mar. 30, 1999

[54] WASHING MACHINE

[75] Inventors: Do Weon Kim, Seoul; Jong Moon Park; Sung Jae Shin, both of Suwon, all of Rep. of Korea

[73] Assignee: Samsung Electronics Co., Ltd., Suwon, Rep. of Korea

[21] Appl. No.: 861,564

[22] Filed: May 22, 1997

[30] Foreign Application Priority Data

| | | | |
|---|---|---|---|
| May 30, 1996 | [KR] | Rep. of Korea | UM9613953 |
| Oct. 18, 1996 | [KR] | Rep. of Korea | 9646928 |
| Jan. 31, 1997 | [KR] | Rep. of Korea | UM971422 |

[51] Int. Cl.[6] ..... D06F 37/24

[52] U.S. Cl. ..... 068/23.3; 248/613; 248/638

[58] Field of Search ..... 68/23.3, 23.1; 210/144, 364; 494/92; 248/612, 613, 638

[56] References Cited

U.S. PATENT DOCUMENTS

| | | | |
|---|---|---|---|
| 3,744,746 | 7/1973 | Weir et al. | 210/364 X |
| 4,625,529 | 12/1986 | Anderson | 68/23.3 |
| 5,520,029 | 5/1996 | Savkar | 68/23.1 X |
| 5,606,879 | 3/1997 | Froelicher et al. | 68/23.3 |

FOREIGN PATENT DOCUMENTS

| | | | |
|---|---|---|---|
| 276298 | 10/1992 | Japan | 68/23.3 |
| 319392 | 11/1992 | Japan | 68/23.3 |
| 31293 | 2/1993 | Japan | 68/23.3 |

*Primary Examiner*—Philip R. Coe

*Attorney, Agent, or Firm*—Burns, Doane, Swecker & Mathis, L.L.P.

[57] ABSTRACT

A washing machine includes an external cabinet, an outer tub installed inside the external cabinet, a spin basket rotatably installed inside the outer tub and a plurality of suspension units for suspending the outer tub with respect to the external cabinet. Each of the suspension units comprises: a suspension bar for connecting the outer tub to the external cabinet; a main damper combined with one end of the suspension bar; and an auxiliary damper combined with the one end of the suspension bar, adjacent to said main damper. Accordingly, vibrations and noises of the outer tub can be reduced effectively.

2 Claims, 11 Drawing Sheets

WASHING MACHINE

BACKGROUND OF THE INVENTION

The present invention relates to a washing machine including an external cabinet, an outer tub installed inside the external cabinet, a spin basket rotatably installed inside the outer tub and a plurality of suspension units for suspending the outer tub with respect to the external cabinet, particularly, to a washing machine designed to effectively reduces.

A washing machine is generally provided with an external cabinet and vibratory system, which being constituted an outer tub and spin basket, suspended inside the external cabinet. The spin basket is rotatably installed in the outer tub for containing the laundry. The outer tub containing the spin basket is suspended inside the external cabinet by a plurality of suspension units.

During washing, rinsing and dehydrating operations of the washing machine, there are generated vibrations due to the rotation of the spin basket. The vibrations are severe especially when the load of the laundry is distributed in the spin basket in an unbalanced way. The vibrations of the spin basket are transmitted to the outer tub, to thereby generate vibrations and noises in the outer tub. Thus, the suspension units of the washing machine are provided with a damper for reducing the vibrations of the outer tub.

FIG. 10 shows a conventional washing machine. As shown in FIG. 10, a vibratory system 3 including an outer tub 4 and a spin basket 5 is elastically suspended inside an external cabinet 2 by a plurality of suspension units 61, each being installed at respective corners of the external cabinet 2. A pulsator (not shown) is installed inside the spin basket 5 to rotate washing water. A power transmission unit 9 having a driving motor (not shown) and a shaft assembly (not shown) is installed below the vibratory system. 3 to rotate the spin basket 5 or the pulsator selectively. The driving motor is operated according to a program stored in a controller (not shown) to make the washing machine perform washing, rinsing and dehydrating operations.

As shown in FIG. 10, the conventional suspension unit 61 includes a suspension bar 63 for connecting the outer tub 4 to the external cabinet 2 and a damper 65 installed at the lower end of the suspension bar 63 for supporting the outer tub 4. The damper 65 has a hollow cylinder (not shown) and a piston (not shown) frictionally slidable inside the cylinder, and the piston is combined with the lower end of the suspension bar 63. A balancer 6 is installed at the upper portion of the spin basket 5 to balance a rotation of the spin basket 5. In the above-described structure, when a vibration is generated to the vibratory system 3, that is, the outer tub 4 due to the rotation of the spin basket 5, the piston slides along up and down inside the cylinder, to thereby reduce the vibrations transmitted to the outer tub 4 by the frictional force between the cylinder and the piston.

The vibration of the vibratory system 3 and a cause thereof will be described in detail with reference to FIG. 11. The vibration of the vibratory system 3 may be divided into a translational movement and a rotational movement. The translational movement includes X-, Y- and Z-directional components, and the rotational movement includes pitching (P) with respect to the X-axis, yawing (Y) with respect to the Y-axis and rolling (R) with respect to the Z-axis, respectively. Here, since the Z-directional component of the translational movement and the rolling (R) with respect to the Z-axis, which are basic movement elements according to the operation of the vibratory system 3, are negligible with respect to the vibration of the vibratory system 3. On the other hand, the X- and Y-directional components of the translational movement and the pitching (P) and yawing (Y) with respect to the X- and Y-axes are unnecessary movement elements, which cause a noise and affect the endurance of the washing machine.

The vibration of the vibratory system 3 may be classified into a vibration generated at an initial stage of the dehydrating operation and a vibration generated at the time of an intermittent dehydration during the washing operation. Here, the vibration at the initial stage of the dehydrating operation is of translational movement, while the vibration at the time of the intermittent dehydration is of the rotational movement. Natural frequencies of the vibratory system with respect to the translational and rotational movements are 1.7 Hz (102 rpm) and 4.5 Hz (270 rpm), respectively.

The vibration at the initial stage of the dehydrating operation is caused by an unbalanced rotation of the spin basket 5. That is, when the load of the laundry is unbalanced inside the spin basket 5, the spin basket 5 rotates at an unbalanced state at a frequency range lower than a rotational frequency of 1.7 Hz. At this time, balancing balls (not shown) and a viscous fluid (not shown) in the balancer 6 may move toward the unbalanced load of the laundry. Accordingly, the spin basket 5 adds its unbalanced rotation so that the vibration of the spin basket 5 is increased to cause the noise.

On the other hand, at the time of the intermittent dehydration, the balancing balls and the viscous fluid start to move when the rotational frequency of the spin basket 5 exceeds 1.7 Hz, and the amplitude of the vibration depends on the location of the balancing balls and the viscous fluid at the frequency of 4.5 Hz. For example, if the balancing balls and the viscous fluid moving independently of the rotation of the spin basket 5 are located at the same side of the unbalanced laundry, the vibration becomes severe.

The vibration of the spin basket 5 which is transmitted to the outer tub 4 is decreased by the suspension unit 61.

However, the conventional suspension unit 61 is generally installed to the washing machine 60, based on a washing capacity of the washing machine 60 and experimental data under a no-load test. Thus, the vibration of the vibratory system 3, that is, of the outer tub 4 which is transmitted from the translational and rotational movements of the spin basket 5 can not be suitably decreased, thereby generating the noise to the washing machine. Also, the vibratory system 3 may collide with the external cabinet 2, to thereby obstruct a normal operation of the washing machine or to cause damage to the components of the washing machine.

SUMMARY OF THE INVENTION

It is an object of the present invention to provide a washing machine which is capable of performing washing, rinsing and dehydrating operations at a frequency range lower than the natural frequency of an outer tub, thereby effectively decreasing a vibration of the outer tub and a noise of the washing machine.

To accomplish the above object, there is provided a washing machine including an external cabinet, an outer tub installed inside the external cabinet, a spin basket rotatably installed inside the outer tub and a plurality of suspension units for suspending the outer tub with respect to the external cabinet, each of the suspension units comprising:

- a suspension bar for connecting the outer tub to the external cabinet;
- a main damper combined with one end of the suspension bar; and an auxiliary damper combined with the one end of the suspension bar, adjacent to the main damper.

Here, each of the main and auxiliary dampers has a hollow cylinder and a piston frictionally slidable inside the cylinder, and the suspension bar axially passes through the cylinder and is combined with the piston.

Preferably, the main and auxiliary dampers are independently combined with the suspension bars, respectively Alternatively, the main and auxiliary dampers are jointly connected by the single suspension bar. In this case, the single suspension bar is provided at the one end thereof with a joint having a plurality of forks, and the main and auxiliary dampers are combined with the plurality of forks of the joint, respectively.

To accomplish the above object there is also provided a washing machine comprising:

an external cabinet;

an outer tub installed inside the external cabinet;

a spin basket rotatably installed inside the outer tub;

a plurality of lower suspension units for suspending a lower portion of the outer tub with respect to the external cabinet; and a plurality of upper suspension units for suspending an upper portion of the outer tub with respect to the external cabinet, wherein each of the lower and upper suspension units comprising a suspension bar for connecting the outer tub to the external cabinet, and a damper combined with one end of the suspension bar.

BRIEF DESCRIPTION OF THE DRAWINGS

The above object and advantages of the present invention will become apparent by describing in detail preferred embodiments thereof with reference to the accompanying drawings in which.

DETAILED DESCRIPTION OF THE INVENTION

Figure 1:
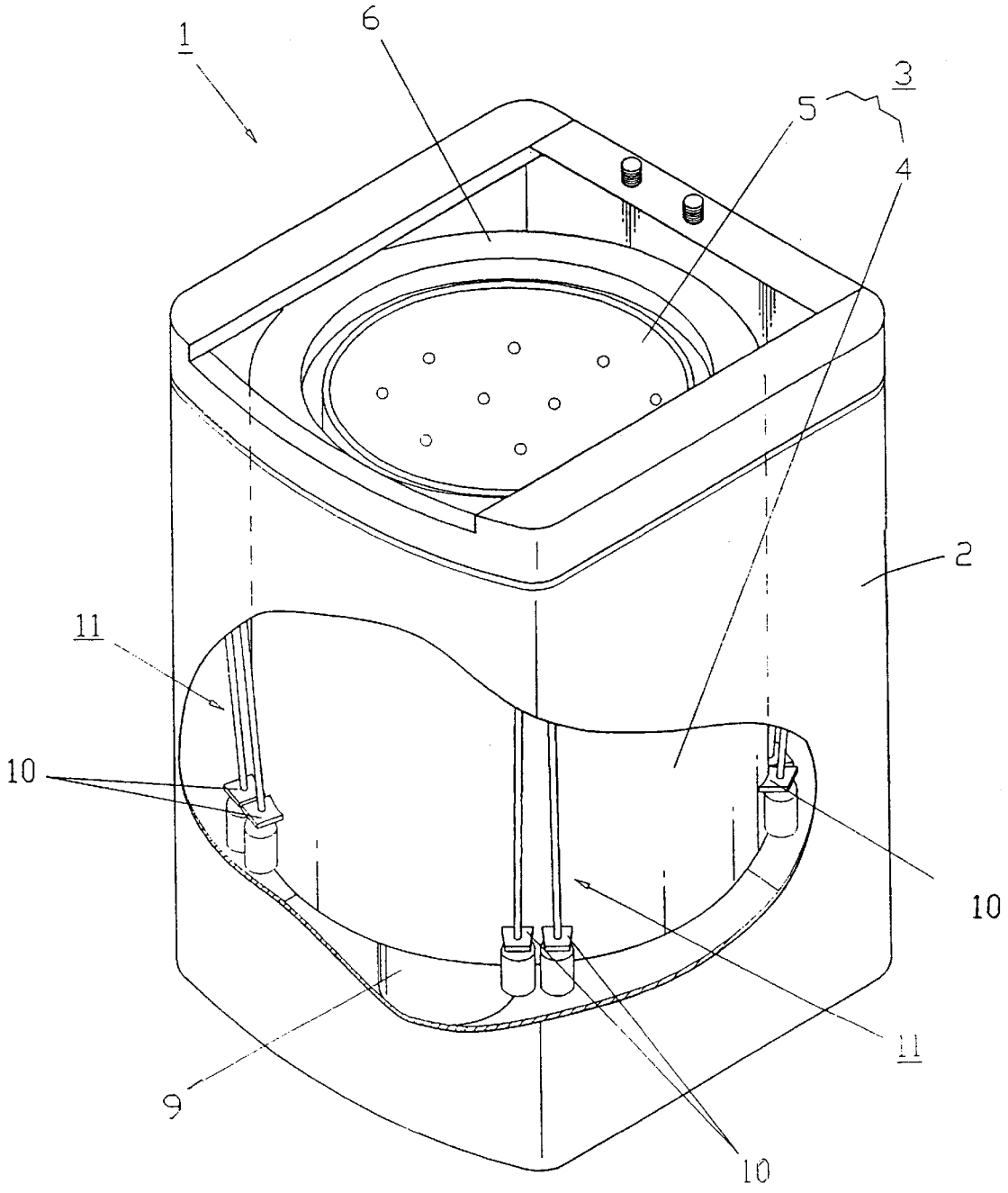
FIG. 1 shows a partially cut-out perspective view of a washing machine according to a first embodiment of the present invention.
Figure 2:
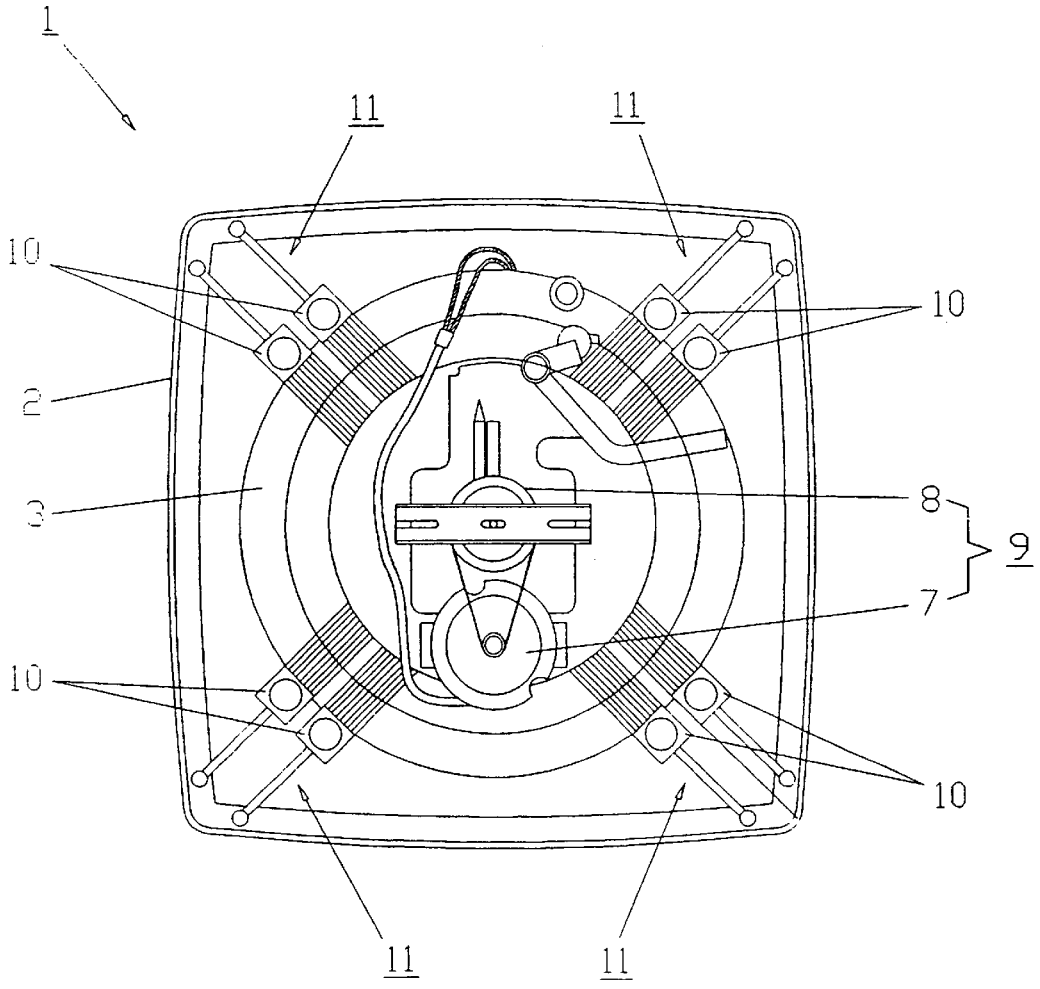
FIG. 2 shows a bottom view of the washing machine in FIG. 1.

Referring to FIGS. 1 and 2, a washing machine 1 according to a first embodiment of the present invention includes an external cabinet 2 and a vibratory system 3 for performing washing, rinsing and dehydrating operations inside the external cabinet 2. The vibratory system 3 includes an outer tub 4 installed inside the external cabinet 2 and a spin basket 5 rotatably installed inside the outer tub 4 to contain the laundry.

Figure 10:
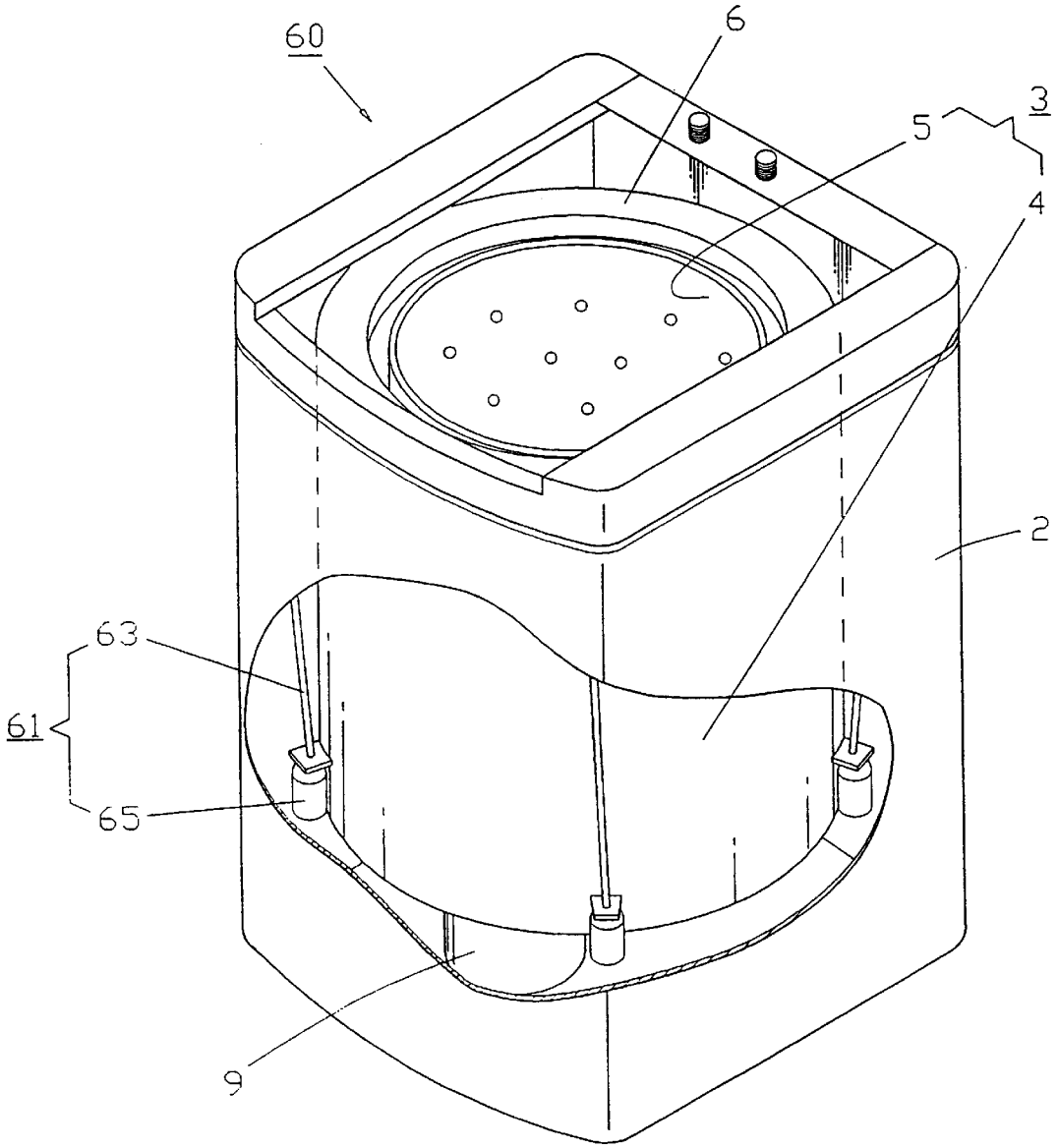
FIG. 10(PRIOR ART)
FIG. 10 shows a perspective view of the conventional washing machine.
Figure 11:
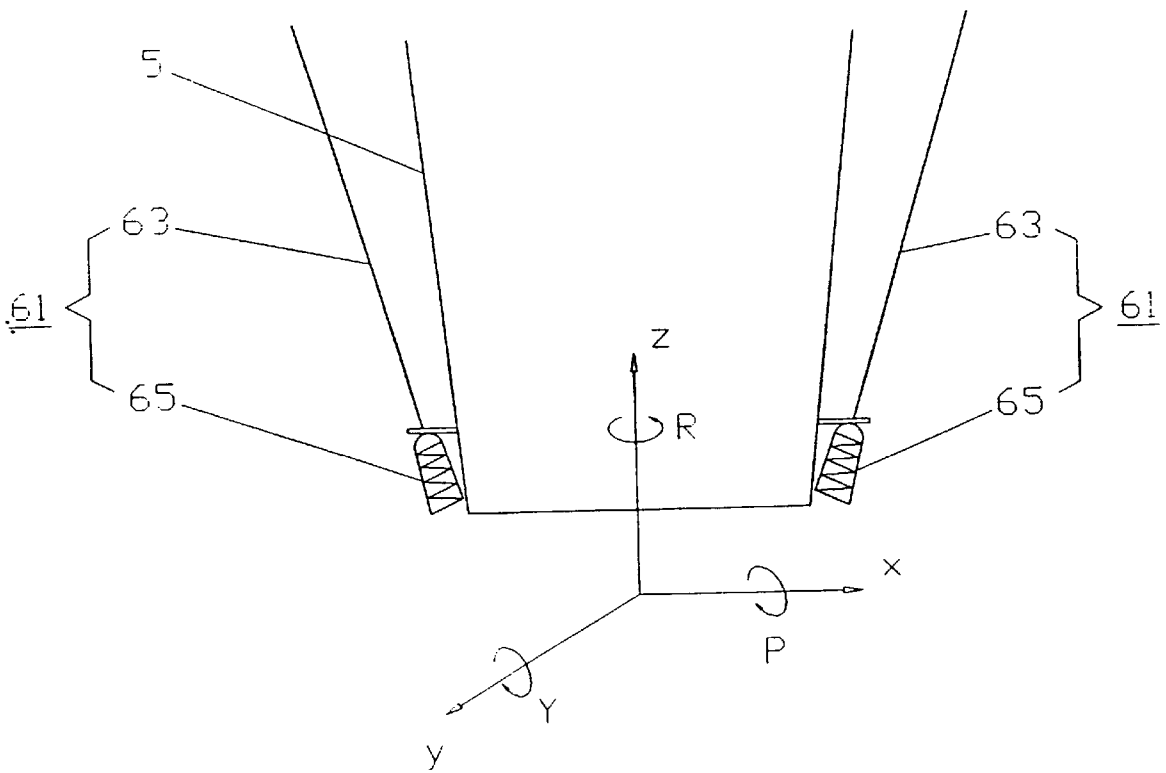
FIG. 11(PRIOR ART)
FIG. 11 is a diagram for explaining vibration modes of a typical washing machine.

The external cabinet 2 has an approximately rectangular cylinder shape, while the outer tub 4 and the spin basket 5 each have circular cylinder shapes. The spin basket 5 is formed with a plurality of holes on the wall thereof such that washing water communicates between the spin basket 5 and the outer tub 4. An annular ball balancer 6 is installed at the upper portion of the spin basket 5. The ball balancer 6 has a multiplicity of balancing balls 55 and a viscous fluid 53 contained in an annular casing 57, as shown in FIG. 10. The balancing balls 55 and the viscous fluid 53 function to balance a rotation of the spin basket 5. A pulsator 51 is installed at the bottom of the spin basket 5, as shown in FIG. 10, to generate a spiral flow of the washing water.

The vibratory system 3 is elastically suspended inside the external cabinet 2 by a plurality of suspension units 11. The number of the suspension units is preferably eight, that is, four pairs, and each pair of suspension units are located at each corner of the external cabinet 2.

A power transmission unit 9 having a driving motor 7 and a shaft assembly 8 is fixedly installed below the outer tub 4, being surrounded by a saddle (not shown). The power transmission unit 9 selectively rotates the spin basket 5 or the pulsator 51 in a forward or reverse direction according to a program stored in a controller (not shown), to perform washing rinsing and dehydrating operations.

Figure 3:
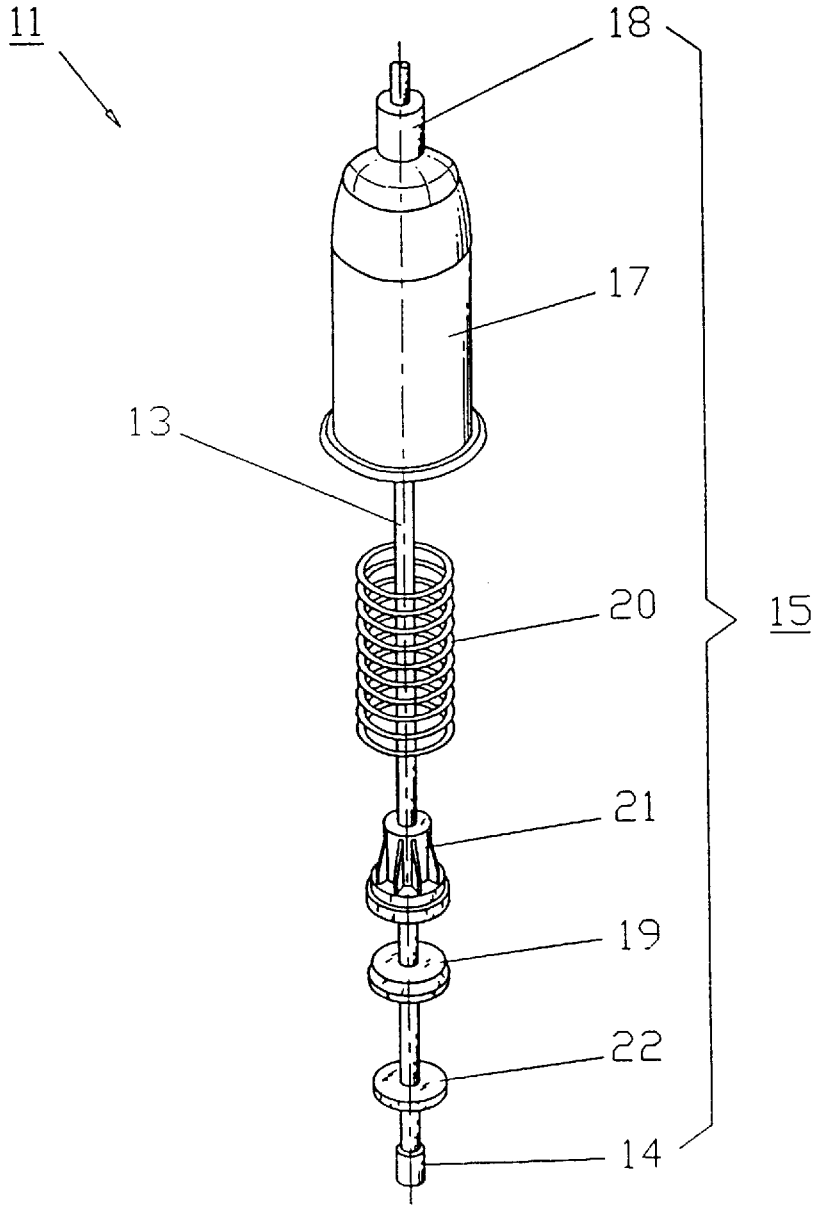
FIG. 3 shows an exploded perspective view of a damper for use in the washing machine in FIG. 1.

Referring to FIG. 3, each of the suspension units 11 for use in the washing machine according to the first embodiment includes a suspension bar 13 and a damper 15 combined with the lower end portion of the suspension bar 13. The suspension bar 13 preferably having a circular section is combined with a lug 10 equidistantly fixed along the circumferential direction on the lower portion of the outer tub 4 to correspond to each upper corner of the external cabinet 2. A stopper 14 is provided at the lower end of the suspension bar 13 to prevent the damper 15 from breaking away from the suspension bar 13.

The damper 15 includes a hollow cylinder 17 and a piston 19 frictionally slidable inside the cylinder 17. A neck member 18 is installed at the top of the cylinder 17 to guide the suspension bar 13. The suspension bar 13 axially passes through the cylinder 17, the piston 19 and the neck member 18 and the piston 19 passed through by the suspension bar 13 can move up and down in the cylinder. A buffer spring 20 is disposed between the cylinder 17 and the piston 19 to elastically bias the piston 19 downwardly. A spring support 21 and a washer 22 are installed between the buffer spring 20 and the piston 19 and between the piston 19 and the stopper 14, respectively.

The damper 15 is installed to the outer tub 4 by combination of the neck member 18 with the lug 10 (FIG. 1). The upper end portion of the suspension bar 13 is combined with the upper inner wall (not shown) of the external cabinet 2. The outer tub 4 is suspended inside the external cabinet 2 by the set of combination structure.

In the above-structured washing machine, the vibration of the vibratory system, that is, the X- and Y-directional components of the translational movement and the pitching (P) and yawing (Y) with respect to the X- and Y-axes (see FIG. 12), which are severe especially at the initial stage of the dehydrating operation, can be effectively decreased by the pair-structured suspension units. At this time, the vibration is absorbed by a frictional contact between the piston 19 and the cylinder 17 and a buffering action of the spring 20.

According to the present embodiment, since the number of the suspension units 11 is larger than that of the suspension units 61 of the conventional washing machine 60, the spring constant of the buffer spring 20 may be decreased to enhance the buffering function of the buffer spring 20. For example, while the spring constant of a spring of the suspension unit 61 for use in a conventional washing machine 60 having the capacity of 8 kg is 0.3 kgf/mm and above, that of the buffer spring 20 of the suspension unit 11 for use in the washing machine 1 according to the present embodiment can be decreased to 0.15 kgf/mm and above, that is, half of the former. Accordingly, the washing machine 1 is capable of improving the washing function due to the improved buffering function of the buffering spring 20.

Figure 4:
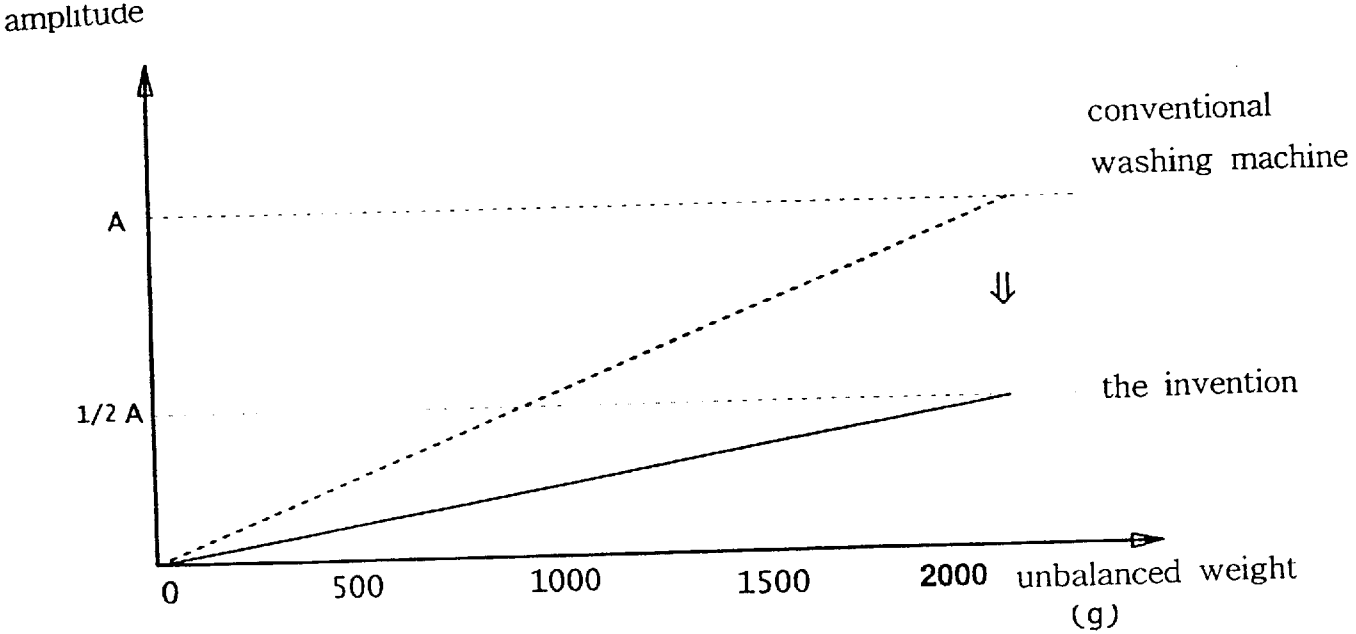
FIG. 4 is a graph for explaining vibrations at initial stages of dehydrating operation, in the washing machine of FIG. 1 in contrast to a conventional washing machine.

The vibration damping effect of the present embodiment is shown in FIGS. 4. That is, it can be seen that amplitudes of the vibrations in the washing machine 1 according to the present embodiment are approximately halves of those of the vibrations in the conventional washing machine 60 at the initial stages of the dehydrating operations.

Hereinafter, modified embodiments of the present invention will be described with reference to FIGS. 6 through 10.

Figure 5:
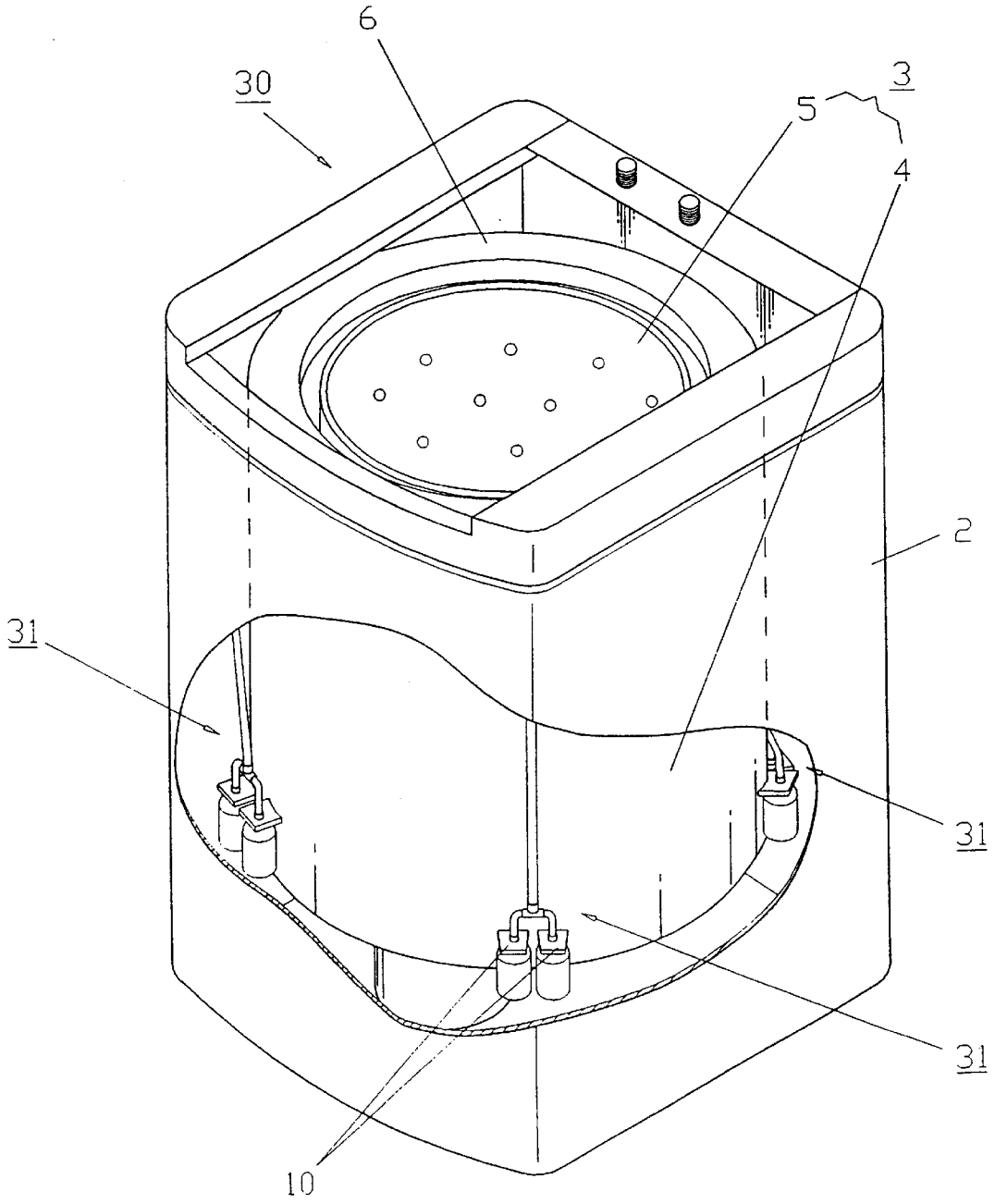
FIG. 5 shows a partially cut-out perspective view of a washing machine according to a second embodiment of the present invention.
Figure 6:
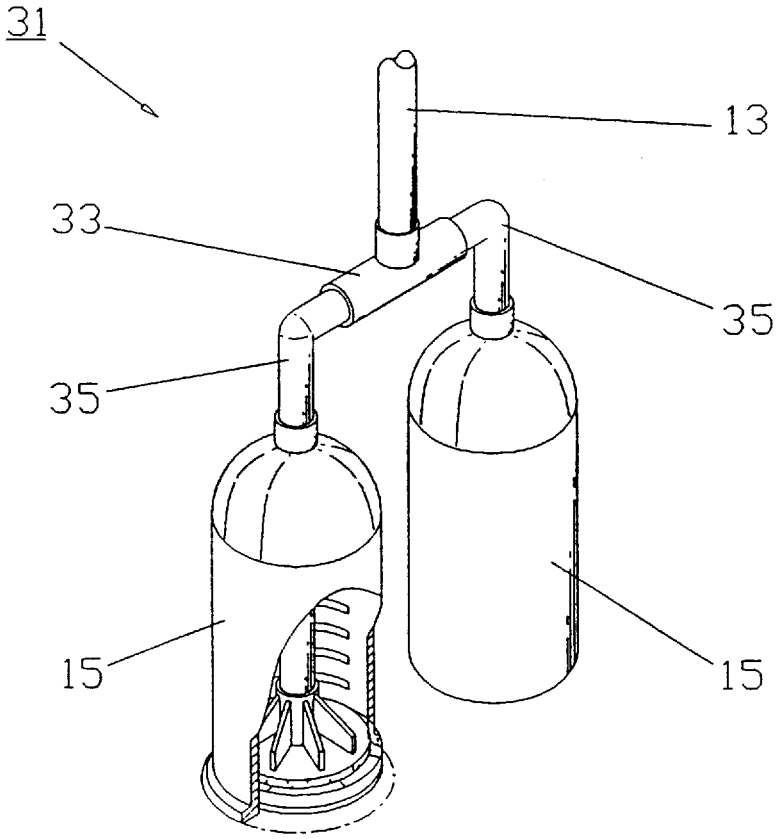
FIG. 6 shows a perspective view of a suspension unit for use in the washing machine of FIG. 5.

Referring to FIG. 5, a washing machine 30 according to a second embodiment of the present invention includes the same elements as in the washing machine 1 according to the first embodiment shown in, FIGS. 1 and 2. However, a suspension unit 31 of the present embodiment has a modified structure compared with the suspension unit 11 in FIGS. 1 and 2. That is, the suspension unit 31 of the present embodiment has a single suspension bar 13 with respect to a pair of dampers 15. The suspension bar 13 has at the lower end thereof a T-shaped joint 33 having two opposite forks, as shown in FIG. 6. A pair of elbow-shaped rods 35 are fitted in the two forks of the joint 33, respectively. The dampers 15 are combined with the lower ends of the rods 35, respectively.

Figure 7:
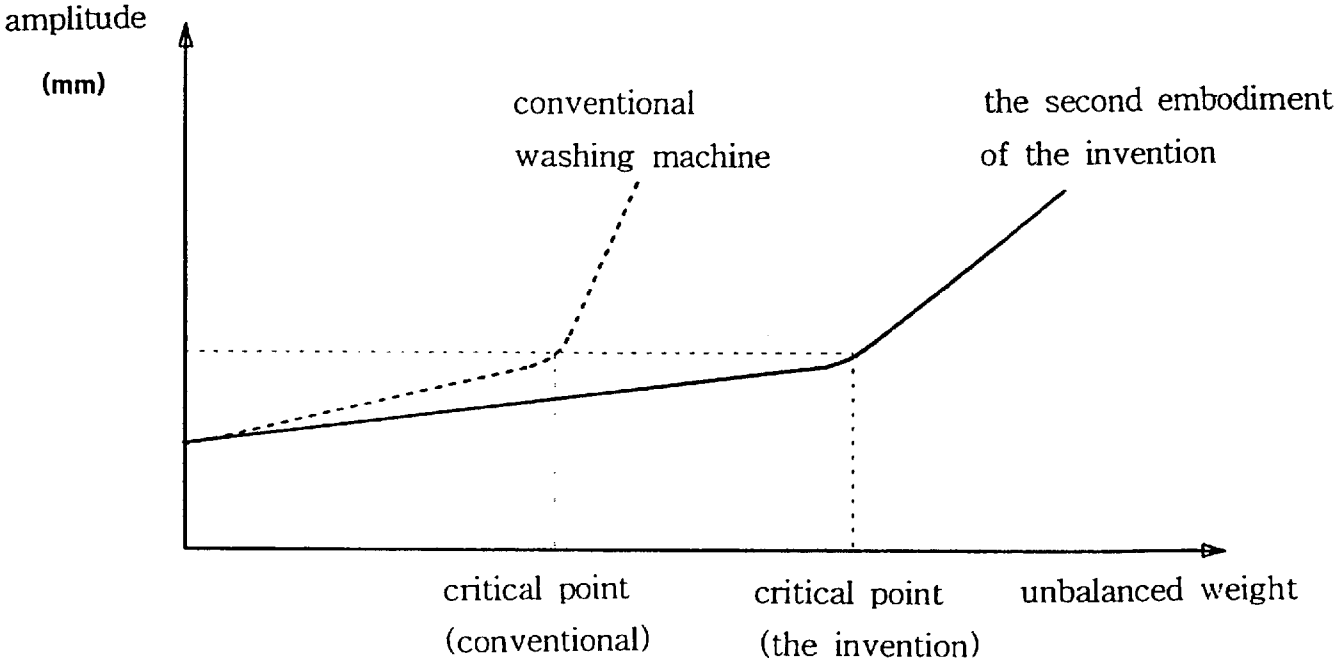
FIG. 7 is a graph for explaining vibrations at initial stages of dehydrating operation, in the washing machine of FIG. 6 in contrast to the conventional washing machine.

FIG. 7 is a graph for explaining vibrations at initial stages of dehydrating operations, in the washing machine 30 in FIG. 5 and the conventional washing machine 60, respectively. As can be seen in FIG. 7, the amplitude of the vibration in the washing machine 30 according to the present embodiment is approximately half of that of the conventional washing machine. Therefore, the spring constant of the spring 20 used in the suspension unit according to the present embodiment can be decreased as in the first embodiment.

As shown in FIG. 5, the suspension bar 13 and the rods 35 which are combined with the lugs 10 have a three-point supporting structure with respect to the outer tub 4, so that torsion of the outer tub 4 which may be generated due to the moment of inertia of the vibratory system 3 during washing, rinsing and dehydrating operations can be effectively prevented.

In the washing machine 30 according to the present embodiment, the two dampers 15 are disposed in parallel. However, three or more dampers 15 may be employed and also, a plurality of dampers 15 may be disposed in series, according to the characteristics and capacity of the washing machine.

In the present embodiment, the rods 35 are connected to the suspension bar 13 via the T-shaped joint 33. However, the rods 35 and the suspension bar 13 may be integrally formed to simplify the structure of the suspension unit 31.

Figure 8:
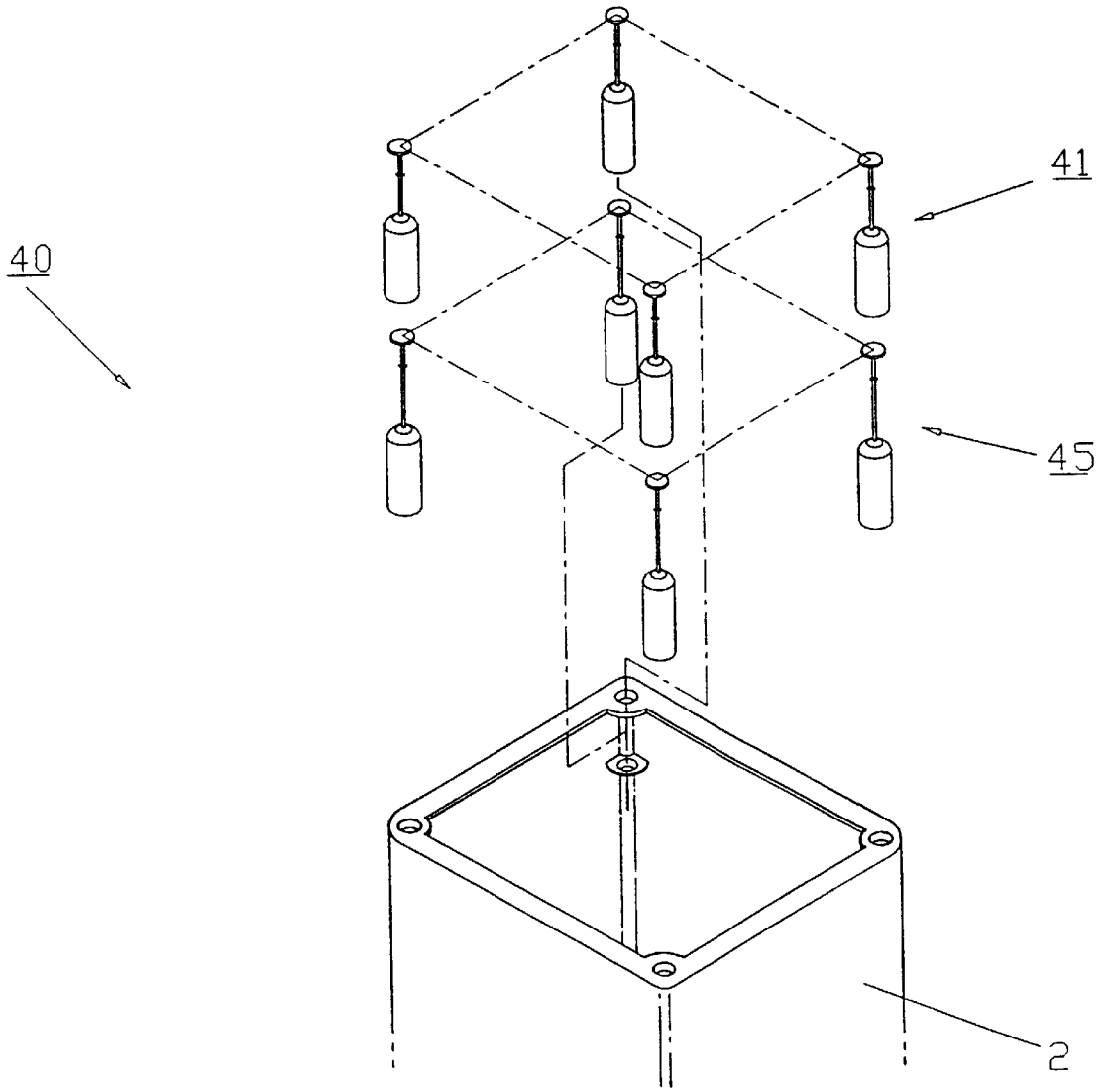
FIG. 8 partially shows an exploded perspective view of a washing machine according to a third embodiment of the present invention.
Figure 9:
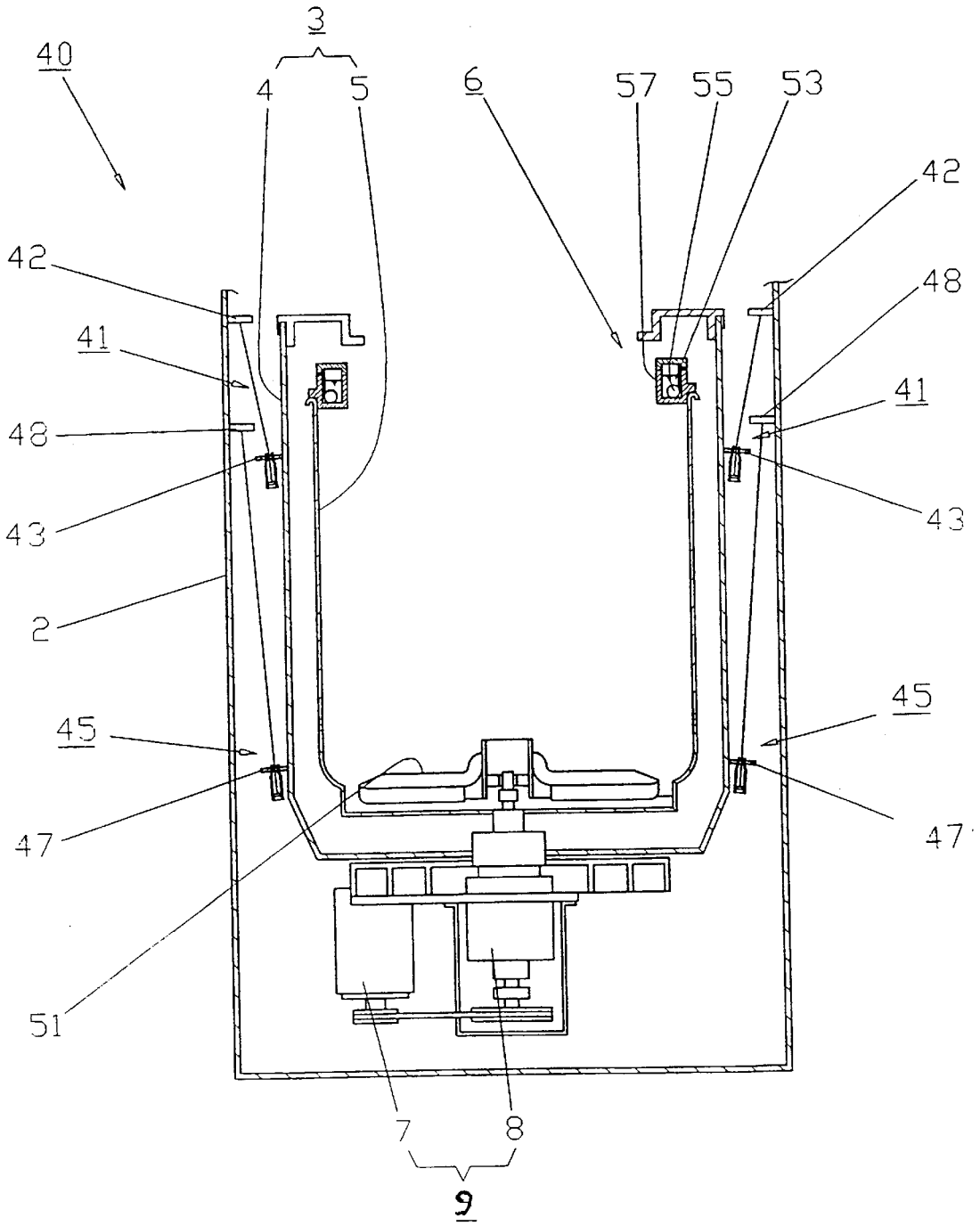
FIG. 9 is a section view of the washing machine in FIG. 9.

Referring to FIGS. 8 and 9, a washing machine 40 according to a third embodiment of the present invention includes four upper suspension units 41 for supporting the upper portion of the outer tub 4 and four lower suspension units 45 for supporting the lower portion of the outer tub 4. Four upper lugs 43 and four lower lugs 47 are respectively fixed equidistantly at the upper and lower portions of the outer tub 4 along the circumferential direction of the outer tub 4, each corresponding to each corner of the external cabinet 2. The upper corner portions of the external cabinet 2 are respectively provided with four upper supporting lugs 42 and four lower supporting lugs 4 disposed below the upper supporting lugs 42, to which the upper and lower suspension units 41 and 45 are connected, respectively. Each of the suspension units 41 and 45 has the same structure as in the suspension unit 11 described with reference to FIG. 3. In the present embodiment, the similar vibration damping effect as in the first and second embodiments can be obtained.

As described above, in a washing machine according to the present invention, an outer tub is suspended inside an external cabinet by a suspension unit having a plurality of dampers, so that a vibration transmitted to the outer tub during washing, rinsing and dehydrating operations can be significantly decreased. Therefore, the outer tub can maintain a frequency range lower than the natural frequency thereof, thereby decreasing a noise of the washing machine remarkably.

What is claimed is:

1. A washing machine including an external cabinet, an outer tub installed inside said external cabinet, a spin basket rotatably installed inside said outer tub and a plurality of suspension units for suspending said outer tub with respect to said external cabinet, each of said suspension units comprising:

a suspension bar for connecting said outer tub to said external cabinet;

a main damper combined with the one end of said suspension bar; and an auxiliary damper combined with the one end of said suspension bar, adjacent to said main damper;

wherein each of said main and auxiliary dampers has a hollow cylinder and a piston frictionally slidable inside said cylinder, and said suspension bar axially passes through said cylinder and is combined with said piston.

2. A washing machine including an external cabinet, an outer tub installed inside said external cabinet, a spin basket rotatably installed inside said outer tub and a plurality of suspension units for suspending said outer tub with respect to said external cabinet, each of said suspension units comprising:

a suspension bar for connecting said outer tub to said external cabinet;

a main damper combined with the one end of said suspension bar; and an auxiliary damper combined with the one end of said suspension bar, adjacent to said main damper;

wherein said main and auxiliary dampers are jointly connected by said single suspension bar; and said single suspension bar is provided at the one end thereof with a joint having a plurality of forks, and said main and auxiliary dampers are combined with said plurality of forks of said joint, respectively.

* * * * *